US007563139B1

(12) United States Patent
Wang

(10) Patent No.: US 7,563,139 B1
(45) Date of Patent: Jul. 21, 2009

(54) CONNECTING ARRANGEMENT OF ELECTRICAL ADAPTER

(76) Inventor: Lien-Sheng Wang, 8F.-2, No. 27, Alley 32, Lane 318, Sec. 2, Jhongsing Rd., Jhudong Township, Hsinchu County (TW)

( * ) Notice: Subject to any disclaimer, the term of this patent is extended or adjusted under 35 U.S.C. 154(b) by 0 days.

(21) Appl. No.: 12/081,017

(22) Filed: Apr. 9, 2008

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/92*** | (2006.01) |
| ***H01R 33/94*** | (2006.01) |
| ***H01R 33/88*** | (2006.01) |

(52) U.S. Cl. ..... 439/638; 439/620.31

(58) Field of Classification Search ..... 439/638, 439/76.1, 620.26, 620.3, 620.31

See application file for complete search history.

(56) References Cited

U.S. PATENT DOCUMENTS 3,744,003 A * 7/1973 Dipace ..... 439/638

* cited by examiner

*Primary Examiner*—Javaid Nasri
(74) *Attorney, Agent, or Firm*—Birch, Stewart, Kolasch & Birch, LLP

(57) ABSTRACT

An electrical adapter includes a housing comprising a front portion including two compartments and two front slits, and a rear portion including longitudinal slots and a damping section including two side cavities, and bottom channels; two blades each having a rear portion fastened in the slit and the compartment; a PCB in the housing and having a transformer unit; two conductive seats on a front end of the PCB, each seat being fastened in the compartment; elastically bent contacts mounted on a rear end of the PCB, the contact including a connecting surface and an axial central positioning groove on the connecting surface; and an electrical wire having its rear portion bent to pass the channel to fasten an end electrical terminal of either conductor thereof on the groove in the cavity and electrically connect same to the connecting surfaces.

3 Claims, 5 Drawing Sheets

CONNECTING ARRANGEMENT OF ELECTRICAL ADAPTER

BACKGROUND OF THE INVENTION

1. Field of Invention

The invention relates to electrical adapters and more particularly to such an electrical adapter having an improved connecting arrangement.

2. Description of Related Art

A conventional electrical adapter for, for example, a portable radio is shown in FIG. 1. The adapter comprises a housing (not numbered), a transformer unit 6, a plug assembly 7 including two spaced conductive posts 71 each electrically connected to a blade (not numbered), two connecting elements 9 having an upper contact 91 electrically connected to one of two output terminals of the transformer unit 6, and a lower engaging member 92 of C-section, the engaging member 92 having a longitudinal gap (not numbered) adapted to matingly put on the post 71, and a bottom plate (not numbered) threadedly secured to the housing. The adapter has the advantages of easy assembly, easy component replacement, and without soldered components.

However, the well known electrical adapter suffers from a disadvantage. In detail, the transformer unit 6 and the plug assembly 7 are required to provide with the engaging members 92 and the posts 71 respectively in order to effect the engagement of the engaging members 92 with the posts 71. This can lower yield and greatly increase the manufacturing cost. Thus, the need for improvement still exists.

SUMMARY OF THE INVENTION

It is therefore one object of the invention to provide an electrical adapter comprising a housing comprising a front extending portion including two compartments and two slits on a front wall of the compartment, and a rear extending portion including a plurality of longitudinal slots, and a damping section extending rearward from the slots and including two cavities of different sizes open to the sides, and a plurality of bottom channels open to the rear end of the damping section and the channels; two blades each having a rear portion fastened in the corresponding slit and the corresponding compartment; a PCB mounted in the housing and having a transformer unit; two conductive seats mounted on a front end of the PCB, each seat being fastened in the compartment; a plurality of elastically bent contacts mounted on a rear end of the PCB, the contact including a connecting surface and an axial central positioning groove on the connecting surface; and an electrical wire having its rear portion bent to pass the channel to position an end electrical terminal of either conductor thereof on the positioning groove in the cavity and electrically connect the end electrical terminal of either conductor thereof to the connecting surfaces, wherein the electrical terminals are urged rearward by the contacts to be squeezed between the positioning groove and the rear end of the slot.

The above and other objects, features and advantages of the invention will become apparent from the following detailed description taken with the accompanying drawings.

DETAILED DESCRIPTION OF THE INVENTION

Figure 1:
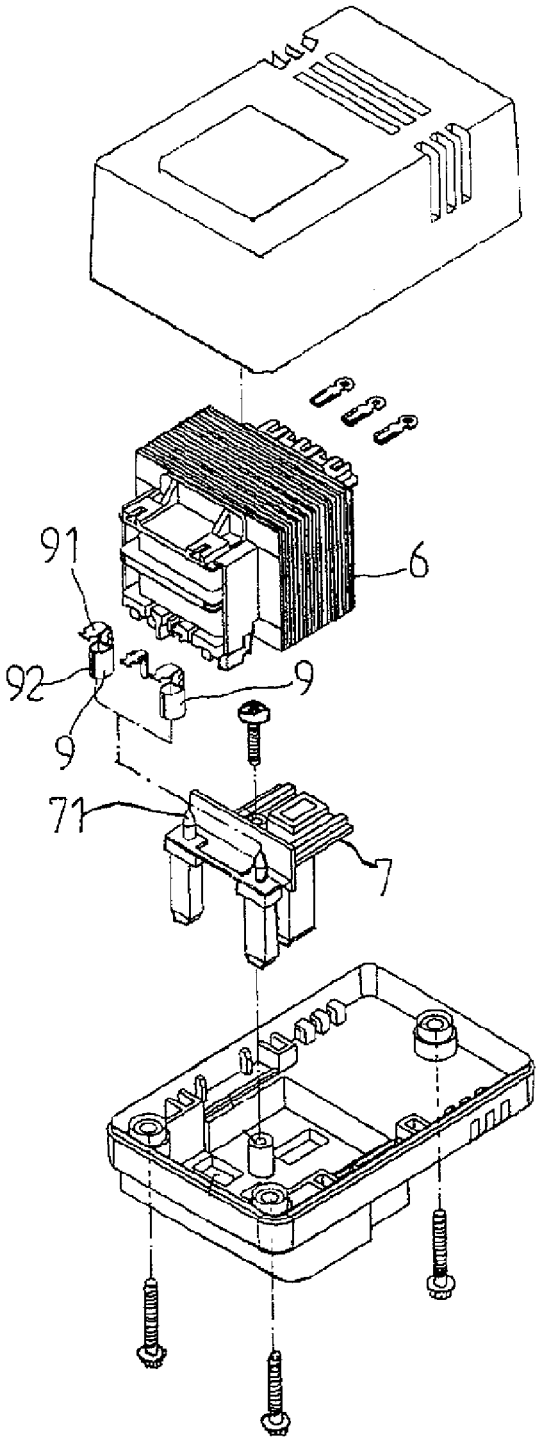
Fig. 1 PRIOR ART
FIG. 1 is an exploded view of a conventional electrical adapter.
Figure 2:
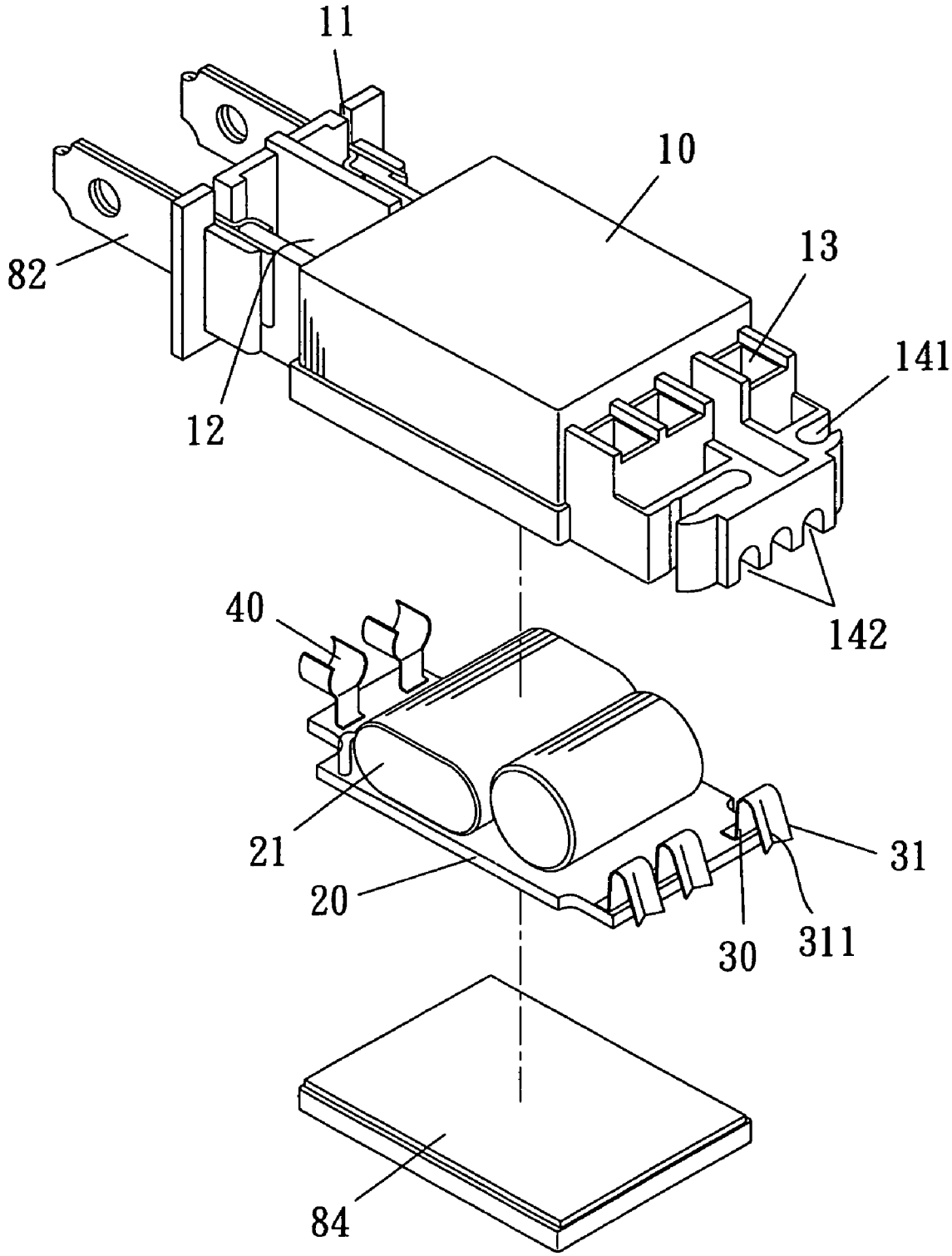
FIG. 2 is an exploded view of a preferred embodiment of electrical adapter according to the invention.
Figure 3:
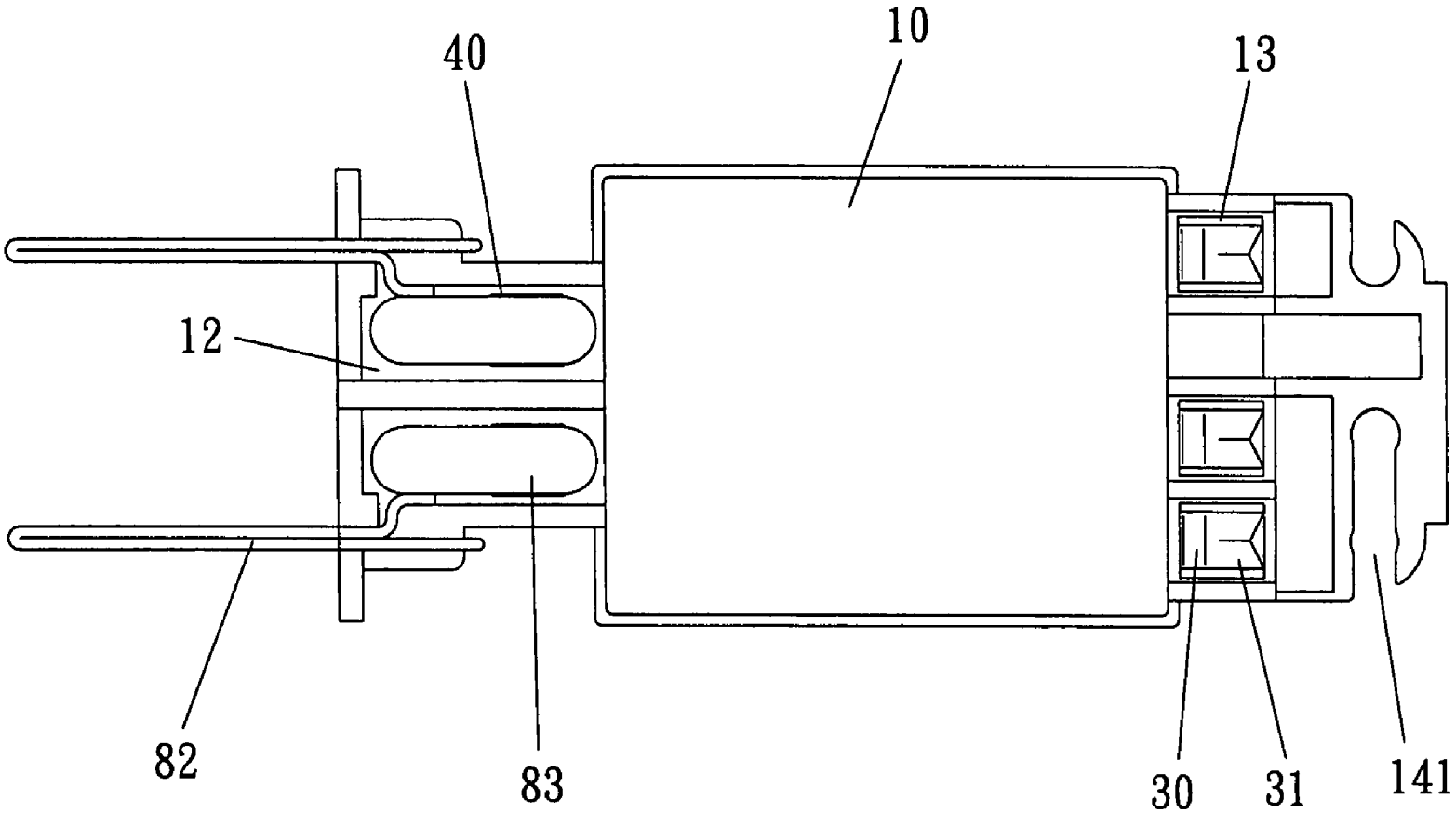
FIG. 3 is a top plan view of the assembled electrical adapter of FIG. 2.
Figure 4:
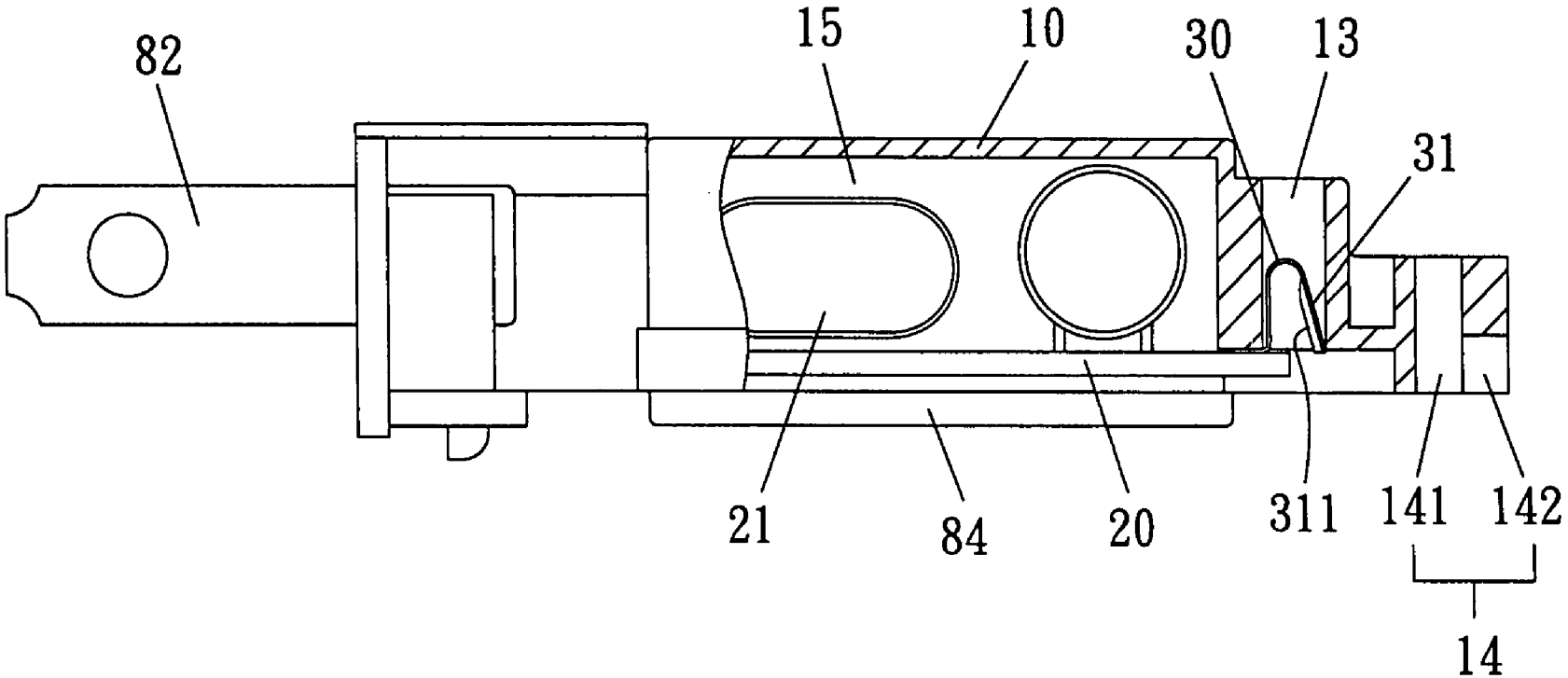
FIG. 4 is a side elevation in part section of the electrical adapter of FIG. 3.

Referring to FIGS. 2 to 5, an electrical adapter in accordance with a preferred embodiment of the invention comprises a housing 10 including a front portion including two compartments 12 divided by a wall, and two slits 11 each formed on a front wall of the compartment 12. Either blade 82 has a rear portion fastened in the slit 11 and the compartment 12 of the same side.

The adapter further comprises a PCB (printed circuit board) 20 including an electrical component (e.g., transformer unit) 21 mounted thereon. The PCB 20 is mounted within the housing 10. A bottom plate 84 is mounted at the bottom of the housing 10 to fasten the PCB 20 in the housing 10. Two copper seats 40 of concave section are mounted on a front end of the PCB 20. The seats 40 are fastened in the compartments 12 respectively. Further, two fuses 83 are fastened on the seats 40 and are electrically connected to both the seats 40 and the blades 82.

The adapter further comprises a series of (three) elastically bent contacts 30 mounted on a rear end of the PCB 20. The contact 30 comprises a connecting surface 31 facing rear and an axial central positioning groove 311 on the connecting surface 31.

The housing 10 further comprises a rear portion including three spaced slots 13 open to both top and bottom, and a damping section 14 extending rearward from the slots 13 and including two cavities 141 of different sizes open to the sides, and a series of bottom channels 142 in the rear end of the damping section 14, the channels 142 being in communication with the cavities 141.

Figure 5:
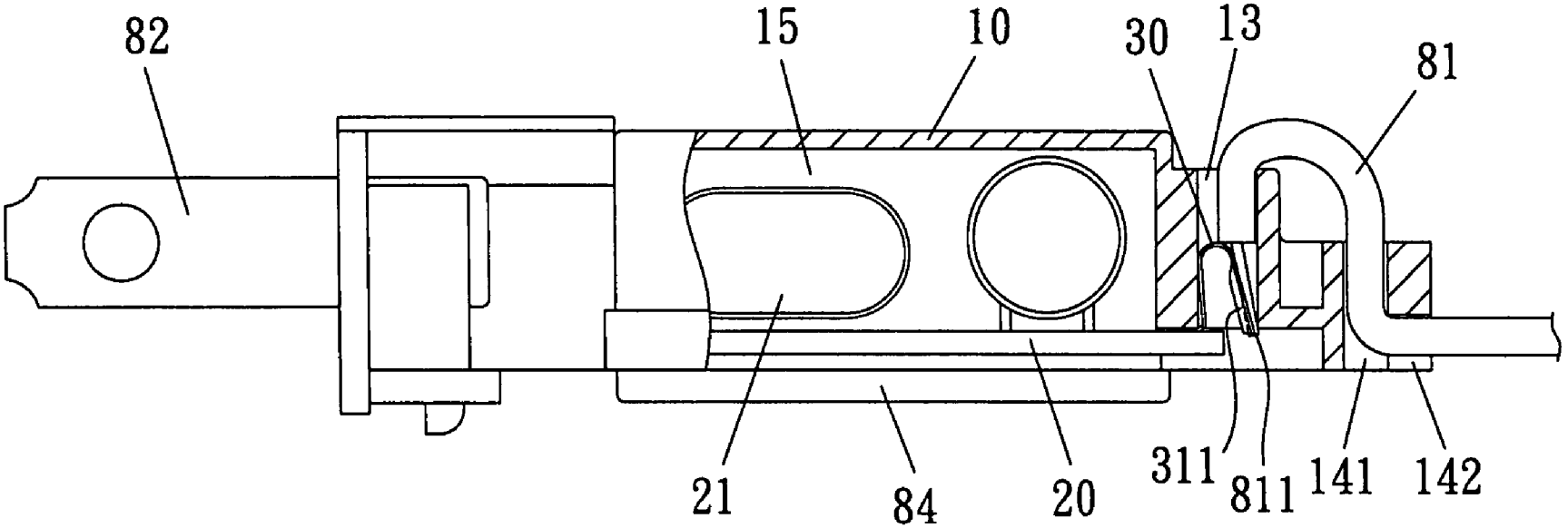
FIG. 5 is a view similar to FIG. 4 showing the electrical wire being secured to the contacts by bending to pass the damping section.

The adapter further comprises an electrical wire 81 having its rear portion bent to pass the channel 142 to position an end electrical terminal 811 of either conductor thereof on the groove 311 of the connecting surface 31 in the cavity 141. As shown in FIG. 5, the electrical terminal 811 is urged rearward by the contact 30 to be squeezed between the groove 311 and the rear wall of the slot 13. Thus, the electrical terminals 811 are reliably electrically connected to the connecting surfaces 31. It is contemplated by the invention that a pulling of the electrical wire 81 will not easily disengage the electrical wire 81 from the contacts 30.

While the invention herein disclosed has been described by means of specific embodiments, numerous modifications and variations could be made thereto by those skilled in the art without departing from the scope and spirit of the invention set forth in the claims.

What is claimed is:

1. A housing (10) comprising a front extending portion including two compartments (12) and two slits (11) on a front wall of the compartment (12), and a rear extending portion including a plurality of longitudinal slots (13), and a damping section (14) extending rearward from the slots (13) and including two side cavities (141) of different sizes, and a plurality of bottom channels (142) open to the rear end of the damping section (14) and the channels (142);

two blades (82) each having a rear portion fastened in the corresponding slit (11) and the corresponding compartment (12);

a PCB (printed circuit board) (20) mounted in the housing (10) and having a transformer unit (21);

two conductive seats (40) mounted on a front end of the PCB (20), each seat (40) being fastened in the compartment (12);

a plurality of elastically bent contacts (30) mounted on a rear end of the PCB (20), each contact (30) including a connecting surface (31) and an axial central positioning groove (311) on the connecting surface (31); and at least one electrical wire (81) having a rear portion thereof bent to pass each channel (142), respectively, to position at least one electrical terminal (811) of the at least one electrical wire (81) on the positioning groove (311) in the cavity (141) and electrically connect the at least one electrical terminal (811) to the connecting surface (31), wherein the at least one electrical terminal (811) is urged rearward by each contact (30), respectively, to be squeezed between the positioning groove (311) and the rear end of the slot (13).

2. The electrical adapter of claim 1, further comprising two fuses (83) fastened on the seats (40) and electrically connected to the seats (40) and the blades (82).

3. The electrical adapter of claim 1, wherein the seats (40) are of concave section.

* * * * *